US007050748B2

(12) United States Patent
Akita et al.

(10) Patent No.: US 7,050,748 B2
(45) Date of Patent: May 23, 2006

(54) FIXING APPARATUS AND IMAGE FORMING APPARATUS HAVING THE SAME

(75) Inventors: Masanori Akita, Ibaraki (JP); Kazuhiro Hasegawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 11/110,713

(22) Filed: Apr. 21, 2005

(65) Prior Publication Data

US 2005/0185995 A1 Aug. 25, 2005

Related U.S. Application Data

(62) Division of application No. 10/400,480, filed on Mar. 28, 2003.

(30) Foreign Application Priority Data

Apr. 1, 2002 (JP) ..... 2002-098620

(51) Int. Cl.
*G03G 15/20* (2006.01)

(52) U.S. Cl. ..... 399/328; 219/216; 399/330; 492/46

(58) Field of Classification Search ..... 399/328, 399/329, 330, 320, 334; 219/216, 469; 118/60; 347/156; 492/46, 18, 25, 28
See application file for complete search history.

(56) References Cited

U.S. PATENT DOCUMENTS

| | | | | |
|---|---|---|---|---|
| 4,937,631 | A | 6/1990 | Kim et al. | 399/222 |
| 5,512,993 | A | 4/1996 | Endo et al. | 399/335 |
| 5,689,788 | A | 11/1997 | Moser | 399/328 |
| 6,047,158 | A | 4/2000 | Morigami et al. | 399/328 |
| 6,229,982 | B1 | 5/2001 | Yamauchi et al. | 399/327 |
| 2002/0172536 | A1 | 11/2002 | Hirst et al. | 399/328 |

FOREIGN PATENT DOCUMENTS

| | | |
|---|---|---|
| JP | 2000-29339 | 1/2000 |
| JP | 2001-265146 | 9/2001 |

*Primary Examiner*—Sophia S. Chen
(74) *Attorney, Agent, or Firm*—Fitzpatrick, Cella, Harper & Scinto

(57) ABSTRACT

A fixing apparatus including a pair of rotary members forming a nip for pinching and conveying a recording material, and a rotatable heat supplying member in contact with at least either of the rotary members and supplying the rotary member with heat. An image forming on the pinched and conveyed recording material is fixed thereto by heat, and the rotary member receiving heat from the heat supplying member has different external diameters along the longitudinal direction and the heat supplying member has different plural external diameters so as to follow the shape of the rotary member.

5 Claims, 3 Drawing Sheets

FIXING APPARATUS AND IMAGE FORMING APPARATUS HAVING THE SAME

This is a divisional of U.S. patent application Ser. No. 10/400,480, filed on Mar. 28, 2003, currently pending.

BACKGROUND OF THE INVENTION

1. Field of the Invention

The present invention relates to a heating apparatus including a heat roller and a pressure roller which are mutually contacted at a surface and are freely rotatable, and an external heating roller which is contacted with the surface of at least one of the rollers and is rotated while heating such surface of the roller by an internal heat source, and adapted to heat a heated member while pinching and conveying the same between the aforementioned heating roller and the aforementioned pressure roller, and it also relates to a fixing apparatus for heat-fixing a toner image, formed on a recording material by an image forming apparatus of electrophotographic process such as a printer or a copying apparatus, to such recording material by utilizing the aforementioned heating apparatus.

2. Related Background Art

A known image forming apparatus of electrophotographic process is equipped with a fixing apparatus which fuse-fixes on a transfer material (heated member) serving as a recording material a toner image formed by toner constituted by a resin, a magnetic material, a coloring agent, etc. and electrostatically borne, to such transfer material, by applying heat and pressure while pinching and conveying the transfer material by a nip of a fixing roller (heating roller) and a pressure roller which are rotated in mutual contact.

A fixing roller employed in such fixing apparatus is formed by covering a surface of a cylinder for example of iron or aluminum with a heat-resistant elastic member for example of silicone rubber, and further forming on the surface a heat-resistant releasing resin layer constituted for example by polytetrafluoroethylene (PTFE) or perfluoroalkoxylalkane (FPA). The heat-resistant elastic member for example of silicone rubber is provided on the fixing roller in order to increase the thermal compliance to the toner, thereby providing a sufficient heat amount for fixing a toner layer having plural layers, under mixing thereof, onto the recording material.

The pressure roller is formed, so as to have a certain contact width in a pressed contact with the aforementioned fixing roller, by covering the surface of a cylinder for example of iron or aluminum with a heat-resistant elastic member for example of silicone rubber, and further forming on the surface a heat-resistant releasing resin layer formed for example by polytetrafluoroethylene (PTFE) or perfluoroalkoxylalkane (FPA).

Such fixing apparatus is usually provided with a heat source such as a halogen lamp inside the fixing roller or the pressure roller, and executes heating of the roller by turning on such halogen lamp (internal heating method).

In such internal heating method, in the course of a continuous fixing operation, in case the halogen lamp provided inside the fixing roller is turned on after the surface temperature of the fixing roller becomes lower than a predetermined control temperature, there is required a long time before the heat from the halogen lamp can reach the roller surface because of a low thermal conductivity of the heat-resistant elastic member provided on the surface of the fixing roller. As a result, the surface temperature of the fixing roller continues to lower by the fixing operation till the heat from the halogen lamp reaches the roller surface, thus eventually becoming lower than a minimum fixable temperature and resulting in a fixation failure. A similar drawback is also encountered in case of heating the pressure roller by the internal heating method, since the pressure roller is provided with the heat-resistant elastic layer.

Therefore, in order to avoid such fixation failure, there is employed a method of contacting a roller, incorporating a heat source and constituted by a material of a high thermal conductivity (hereinafter called an external heating roller) with the surface of the fixing roller, and rotating the external heating roller and the fixing roller under pressure contact thereby, directly heating the fixing roller from the surface thereof (external heating method).

In such external heating method, the surface of the external heating roller is controlled at a temperature higher than that of the surface of the fixing roller and the heat is directly transmitted from the external heating roller to the surface of the fixing roller at the contact portion (nip) therebetween, whereby the heat can be instantaneously supplied to the surface of the fixing roller in comparison with the aforementioned internal heating method and the fixing roller can be prevented from the temperature decrease. A similar effect can naturally be obtained also in case an external heating roller is provided on the pressure roller.

However, the aforementioned known external heating method is associated with a following drawback. The external heating roller has so-called straight shape in which the roller diameter remains same, along the longitudinal direction, namely in a central portion and an end portion, regardless of the shape of the fixing roller or the pressure roller, which is to be heated directly in contact with the external heating roller.

On the other hand, the fixing roller may have so-called inversely crowned shape in which the roller diameter is made larger, along the longitudinal direction, in an end portion than in a central portion, thereby applying a force to the recording material in the nip portion toward the ends portions of the roller and thus preventing a crease formation in the recording material at the fixing operation. In case the fixing roller of such inverse crown shape is contacted with the external heating roller of straight shape, since the external heating roller is given a constant pressure to the fixing roller, the pressure becomes larger in a portion of a larger diameter than in a portion of a smaller diameter, whereby, in the contact portion (nip) between the fixing roller and the external heating roller, the elastic layer of the fixing roller shows different crushed amounts. As a result, the nip assumes an inverse crown shape along the longitudinal direction, in which the nip width is larger in end portions than in a central portion. Thus, in the direct heat transfer from the external heating roller to the fixing roller at the contact portion (nip), the amount of heat transfer becomes larger in end portions where the contact width between the external heating roller and the fixing roller is larger, than in central portion, whereby the temperature on the surface of the fixing roller becomes uneven along the longitudinal direction.

On the other hand, in case the fixing roller has a normal crown shape and is contacted with the external heating roller of straight shape, the contact portion (nip) of the fixing roller and the external heating roller assumes a normal crown shape along the longitudinal direction, in which the nip width is larger in a central portion than in end portions, whereby, in the direct heat transfer from the external heating roller to the fixing roller at the contact portion (nip), the amount of heat transfer becomes larger in the central portion where the contact width between the external heating roller and the fixing roller is larger, than in end portion, and the temperature on the surface of the fixing roller again becomes uneven along the longitudinal direction.

Such unevenness in the surface temperature along the longitudinal direction of the fixing roller, if becoming larger, will lead to an unevenness of gloss of the fixed image along the longitudinal direction or an unstable behavior of the paper at the fixing operation, eventually resulting in creases on the paper or an image defect resulting from a flipping of the rear end of the paper sheet.

Also in case an external heating roller of straight shape is contacted with a pressure roller of normal or inverse crown shape, there will similarly result an unevenness in the temperature along the longitudinal direction on the surface of the pressure roller, thereby leading to an unevenness of gloss of the fixed image along the longitudinal direction or an unstable behavior of the paper at the fixing operation, and eventually resulting in creases on the paper or an image defect resulting from a flipping of the rear end of the paper sheet.

SUMMARY OF THE INVENTION

In consideration of the foregoing, an object of the present invention is to supply a rotary member in contact with an external heating member, with heat uniformly along the longitudinal direction.

Another object of the present invention is to provide a fixing apparatus including:

a pair of rotary members forming a nip for pinching and conveying a recording material, wherein an image borne by the pinched and conveyed recording material is fixed by heat to the recording material; and a rotatable heat supplying member maintained in contact with at least either of the rotary members for heat supply thereto;

wherein the rotary member receiving the heat supply from the heat supplying member has different external diameters along the longitudinal direction, and the heat supplying member has a shape with plural different external diameters so as to follow the shape of the rotary member.

DESCRIPTION OF THE PREFERRED EMBODIMENTS

In the following, an embodiment of the present invention will be explained with reference to the accompanying drawings.

(First Embodiment)

Figure 1:
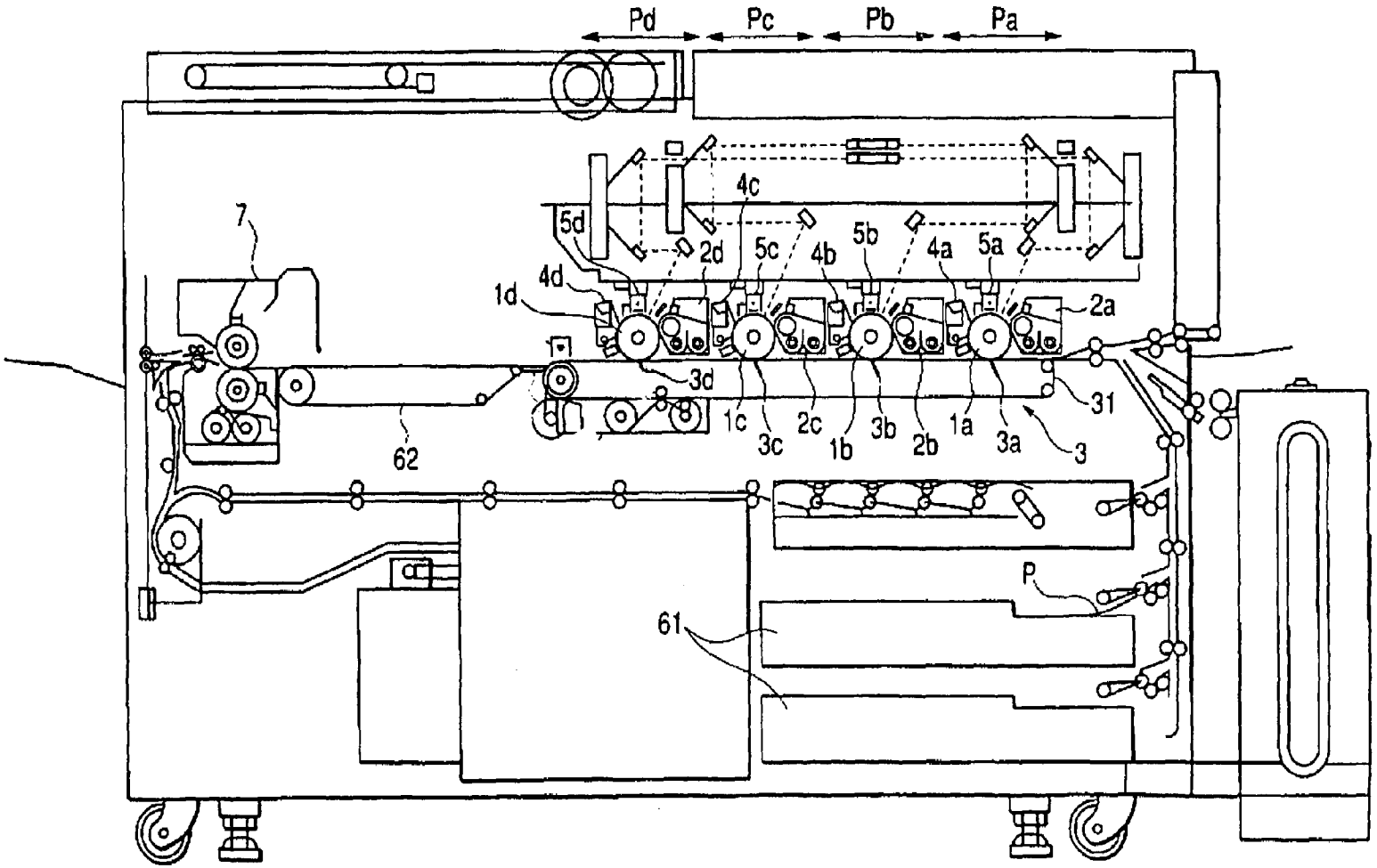
FIG. 1 is a cross-sectional view of an image forming apparatus.

At first reference is made to FIG. 1 for explaining a process relating to image formation. FIG. 1 shows, as an example of an image forming apparatus of the present embodiment, a schematic configuration of a 4-drum laser beam printer (hereinafter simply called printer) having plural optical scanning means. As shown in FIG. 1, the printer of the present embodiment has four image forming stations, each constituting image forming means and having an electrophotographic photosensitive member (hereinafter called photosensitive drum), which constitutes a latent image bearing member and around which a charging apparatus, a developing apparatus, a cleaning apparatus, etc. are provided, and images formed on the photosensitive drums in the respective image forming stations are transferred onto a recording material such as paper (hereinafter simply called paper) on conveying means that passes close to the photosensitive drums.

In image forming stations Pa, Pb, Pc and Pd for forming images of respective colors of magenta, cyan, yellow and black, there are respectively provided photosensitive drums 1*a*, 1*b*, 1*c* and 1*d*, each rendered rotatable in a direction indicated by an arrow. Around the photosensitive drums 1*a*, 1*b*, 1*c* and 1*d*, there are provided chargers 5*a*, 5*b*, 5*c* and 5*d* for charging surfaces of the photosensitive drums, developing apparatuses 2*a*, 2*b*, 2*c* and 2*d* for developing image information formed after charging and image exposure, and cleaners 4*a*, 4*b*, 4*c* and 4*d* for removing toner remaining on the photosensitive drums after image transfer, in succession along the rotating direction of the photosensitive drums, and a transfer unit 3 is provided under the photosensitive drums, for transferring toner images on the photosensitive drums onto a recording material. The transfer unit 3 includes a transfer belt 31 constituting recording material conveying means common to the image forming stations, and transfer chargers 3*a*, 3*b*, 3*c* and 3*d*.

In the above-described printer, a paper P, supplied from a sheet cassette 61 shown in FIG. 1 and serving as recording material supplying means, is supported on the transfer belt 31 and is conveyed to the respective image forming stations, thereby receiving successive transfers of the toner images of the respective colors formed on the photosensitive drums. Through such transfer step, an unfixed toner image is formed on the recording material. The recording material P, bearing such unfixed toner image, is separated from the transfer belt 31 and conveyed to a fixing apparatus 7 by a conveyor belt 62 constituting recording material guide means.

Figure 2:
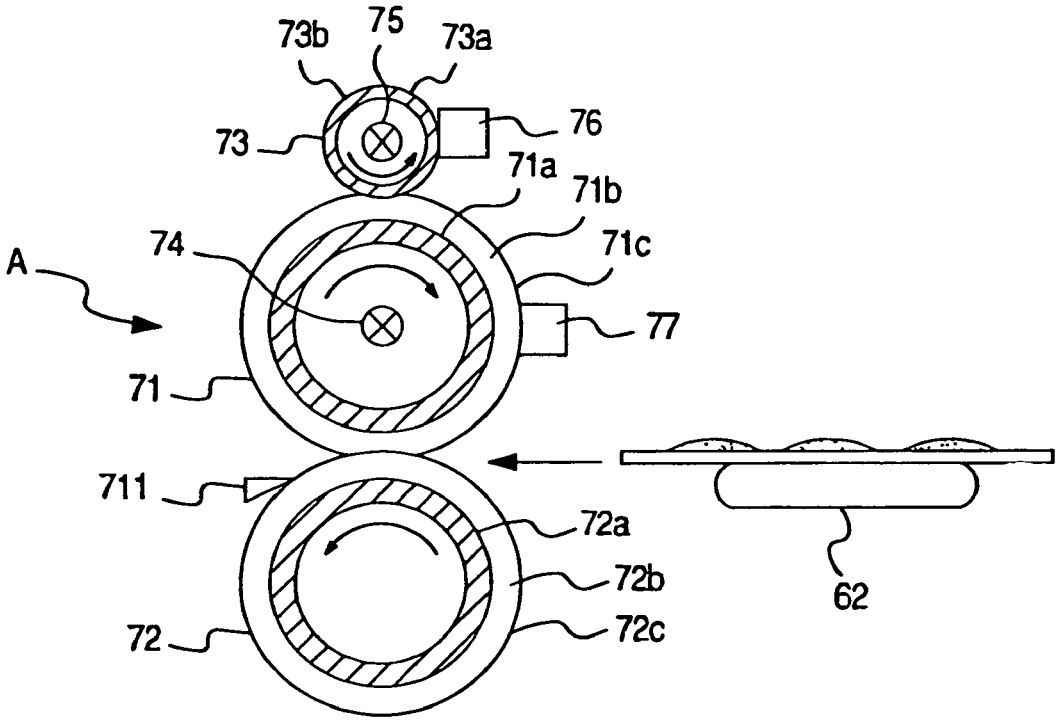
FIG. 2 is a schematic view of a fixing apparatus of an embodiment 1, utilizing a heating apparatus of the present invention.

FIG. 2 is a schematic cross-sectional view showing principal parts of a fixing apparatus, utilizing a heating apparatus of an embodiment 1 of the present invention. Referring to FIG. 2, a fixing apparatus A includes a fixing roller 71 serving as a fixing rotary member and a pressure roller 72 serving as a pressurizing rotary member which are mutually contacted at surfaces and rendered rotatable: an external heating roller 73 including a heat source 75 therein, pressed in contact with the surface of the fixing roller 71 and rendered rotatable, thereby heating the surface of the fixing roller while rotated; a first temperature sensor 77 and a second temperature sensor 76, provided as temperature detecting members in contact with the surfaces of the fixing roller 71 and the external heating roller 73 thereby detecting surface temperatures of these rollers; a conveying guide 62 for guiding a transfer material, bearing an unfixed toner image, to a contact portion (nip) of the fixing roller 71 and the pressure roller 72; and a separating finger 711 maintained in contact with or close to the surface of the pressure roller 72 for separating the transfer material. As explained above, the paired rotary members are constituted by a fixing rotary member and a pressurizing rotary member.

The fixing roller 71 is constituted, for example, by an aluminum cylinder 71*a* of an external diameter of 50 mm and a thickness of 3 mm constituting a metal core, and a surfacial elastic layer of silicone rubber 71*b* of a JIS-A hardness of 30° to 60° and a thickness of 3 mm. For increasing the releasing property of the surface, there may be provided a fluoric resin layer 71*c* for example of PTFE of a thickness of 20 to 70 μm or PFA of a thickness of 50 to 100 μm as a releasing layer.

The pressure roller 72 is constituted, for example, by an aluminum cylinder 72*a* of an external diameter of 38 mm and a thickness of 2 mm constituting a metal core, and a surfacial elastic layer of silicone rubber 71*b* of a JIS-A hardness of 40° to 70° and a thickness of 2 mm. For increasing the releasing property of the surface, there may be provided a fluoric resin layer 71*c* for example of PTFE of a thickness of 20 to 70 nm or PFA of a thickness of 50 to 100 μm as a releasing layer.

Also at the center of the cylinder of the fixing roller 71 and along the axial direction of the rotating axis, a heater 74 is provided as a heat source for example composed of a 500 W halogen lamp having a uniform light distribution along the longitudinal direction, and the fixing roller 71 is heated by activating such heater 74.

The external heating roller 73, constituting the external heating member or the heat supplying member, is constituted by an aluminum or iron cylinder 73*a* of an external diameter 30 mm and a thickness of 3 mm serving as a metal core. On the surface of the cylinder, for increasing the releasing property, there may be provided a coating of a fluoric resin layer 73*b* as a releasing layer. Also on the internal surface of the cylinder of the external heating roller 73, a black coating is provided in order to increase the heat absorption factor.

Also at the center of the cylinder of the external heating roller 73 and along the axial direction of the rotating axis, a heater 75 is provided as a heat source for example composed of a 400 W halogen lamp having a uniform light distribution along the longitudinal direction, and the external heating roller 73 is heated by the function of such heater 75.

Figure 3:
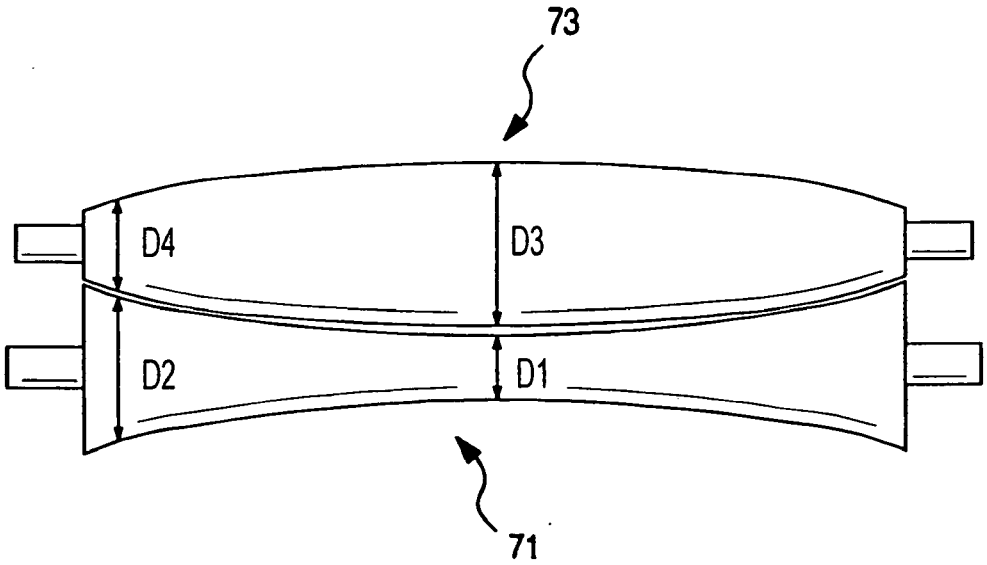
FIG. 3 is a schematic view of a fixing roller and an external heating roller, showing details of the embodiment 1 shown in FIG. 2.
Figure 4:
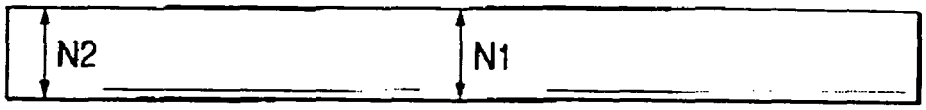
FIG. 4 is a view showing the shape of a nip formed by the fixing roller and the external heating roller, showing the embodiment 1 in FIG. 2.

FIG. 3 is a schematic view best representing the embodiment 1, showing the relation of crowning amounts of the external heating roller 73 and the fixing roller 71. The fixing roller 71 is provided, as a measure against paper creasing, with an inverse crowning in such a manner that an external diameter D1 at a central portion and an external diameter D2 in end portions in the longitudinal direction of the fixing roller 71 have a difference;

$$D2-D1=150-200\ \mu m.$$

The external heating roller 73 is provided with a positive crowning in such a manner that an external diameter D3 at a central portion and an external diameter D4 in end portions in the longitudinal direction of the external heating roller 73 have a difference:

$$D3-D4=150-200\ \mu m.$$

When the external heating roller 73 was pressed to the fixing roller 71 of the aforementioned shapes with a load of about 10 kg, a nip width N1 at the central portion of the fixing roller 71 and the external heating roller 73 was about 4.5 mm, while a nip width N2 at the end portion was about 4.5 mm, almost same as the nip width N1 at the center. As a result, a heat transmission distance (heat transmission amount) from the external heating roller 73 to the fixing roller 71 became uniform along the longitudinal direction and it was made possible to maintain the temperature of the fixing roller uniformly along the longitudinal direction.

In fact, by employing a fixing roller 71 with an inverse crowning of 150 to 200 μm and an external heating roller 73 with a positive crowning of 150 to 200 μm and monitoring the temperature in the central portion and in the end portion (corresponding to an end portion of an A4-sized sheet) of the fixing roller 71 in the course of a continuous fixing operation for 500 A4-sized sheets, it was confirmed that a state with little difference in the surface temperature between the central portion and the end portion of the fixing roller 71 was maintained. An image after fixing was satisfactory without unevenness in the gloss over the entire range in the longitudinal direction.

As explained in the foregoing, the present embodiment 1 is capable, by directly heating the fixing roller 71 from the exterior by the external heating roller 73, of not only effectively preventing the temperature decrease of the fixing roller 71 but also maintaining the temperature of the fixing roller uniformly along the longitudinal direction.

(Second Embodiment)

In the first embodiment, there has been explained an effect of a positive crowning shape provided in the external heating roller 73, in consideration of a situation where the fixing roller 71 has an inverse crowning shape for avoiding paper creases, but also in case the fixing roller 71 has a positive crowning shape in order to reduce the flipping of the rear end of paper, the external heating roller 73 can be provided with an inverse crowning to maintain the nip width between the external heating roller 73 and the fixing roller 71 uniform along the longitudinal direction, thereby maintaining a uniform temperature of the fixing roller along the longitudinal direction.

(Third Embodiment)

A third embodiment of the present invention will be explained with reference to FIGS. 5 and 6.

Figure 5:
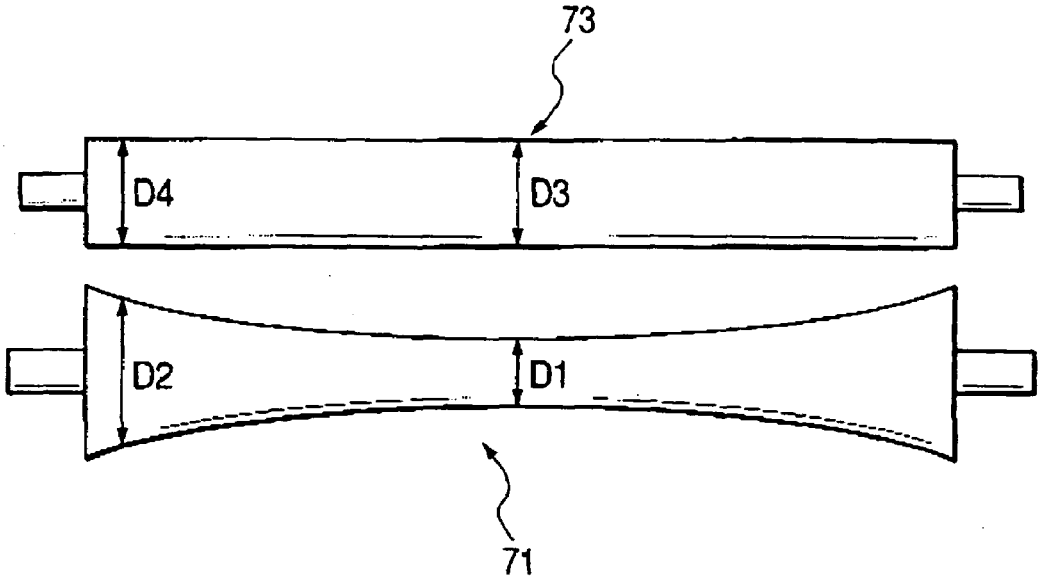
FIG. 5 is a schematic view of a fixing roller and an external heating roller in an embodiment 3.
Figure 6:
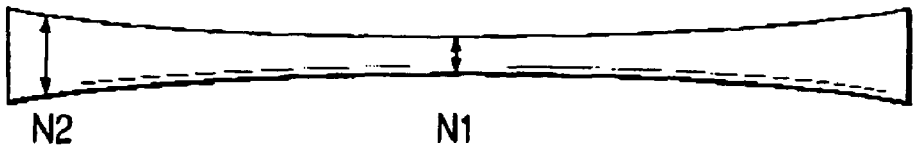
FIG. 6 is a view showing the shape of a nip formed by the fixing roller and the external heating roller, in the embodiment 3 shown in FIG. 5.

Referring to FIG. 5, a fixing roller 71 is provided, as a measure against paper creasing, with an inverse crowning in such a manner that an external diameter D1 at a central portion and an external diameter D2 in end portions in the longitudinal direction of the fixing roller 71 have a difference:

$$D2-D1=150-200\ \mu m.$$

The external heating roller 73 has a straight shape in which the external diameter at a central portion and that at end portions in the longitudinal direction are mutually same. When the external heating roller 73 of the straight shape was contacted by loading to the fixing roller 71 having the inverse crowning of 150 to 200 μm so as to have a nip width N1 of about 4.5 mm at the central portion, the nip width N2 at the end portions was about 5.5 mm and was larger by about 1 mm than in the central portion, as shown in FIG. 6. This means that the heat transmission distance (heat transmission amount) from the external heating roller 73 to the fixing roller 71 is larger in the end portions than in the central portion, along the longitudinal direction.

Therefore, the heater 75 incorporated in the external heating roller 73 was constituted by a halogen lamp having such a light distribution in the longitudinal direction having a relative illumination intensity of 80% in end portions with respect to that of 120% in central portion. The heater 75 of such configuration is used in order to compensate the difference in the amount of the supplied heat resulting from the difference in the heat transmission distance between the central portion and the end portion of the fixing roller 71 and the external heating roller 73 in the longitudinal direction thereof, by the relative illumination intensity of the internal heater 75 of the external heating roller 73, made larger in the central portion than in the end portions, thereby maintaining the heat amount supplied to the fixing roller 71 constant in the longitudinal direction thereof.

By employing the above-described configuration and monitoring the temperature in the central portion and in the end portion (corresponding to an end portion of an A4-sized sheet) of the fixing roller 71 in the course of a continuous fixing operation of 500 A4-sized sheets, it was confirmed that a state with little difference in the surface temperature between the central portion and the end portion of the fixing roller 71 was maintained. It was thus made possible to maintain a state almost without a difference in the surface temperature between the central portion and the end portions of the fixing roller 71 during the fixing operation, and there could be obtained a satisfactory image after fixing without unevenness in the gloss over the entire range in the longitudinal direction.

In the foregoing embodiments, there have been explained cases of applying the heating apparatus of the invention to a fixing apparatus, but the heating apparatus of the present invention is also applicable effectively for crease elimination, surface gloss formation, etc. of a heated member, thereby improving the quality thereof. Also the fixing roller 71 and the external heating roller 73 in the heating apparatus of the present invention may be applied as the fixing roller 71 and the external heating roller 73 of the fixing apparatus shown in FIG. 1, thereby providing an effect of obtaining a fixing apparatus capable of always realizing an appropriate fixing process.

As explained in the foregoing, the present invention is capable not only of effectively preventing the decrease in the temperature of the fixing roller (or pressure roller), but also maintaining the temperature of the fixing roller (or pressure roller) uniformly along the longitudinal direction thereof, thereby providing a satisfactory heating process that the heated material after heating if free from unevenness in the gloss over the entire area in the longitudinal direction.

The present invention has been explained by embodiments thereof, but the invention is not at all limited by such embodiments and is subject to any and all modifications within the technical scope of the present invention.

What is claimed is:

1. A fixing apparatus comprising:

a fixing roller for heat fixing an image on a recording material at a fixing nip, said fixing roller being in contact with the image;

a nip forming member for forming the fixing nip with said fixing roller therebetween; and a heating roller for heating said fixing roller, said heating roller being in contact with an outer surface of said fixing roller, wherein said fixing roller has an external diameter greater at its end portions than at its central portion in a longitudinal direction, and said heating roller has an external diameter smaller at its end portions than at its central portion in a longitudinal direction, according to the external diameter of said fixing roller.

2. An apparatus according to claim 1, wherein a contact width between said fixing roller and said heating roller is substantially uniform in the longitudinal direction.

3. An apparatus according to claim 1, wherein the external diameter at the end portions of said fixing roller is greater than that at the central portion by 150 through 200 μm, and the external diameter at the end portions of said heating roller is smaller than that at the central portion by 150 through 200 μm.

4. An apparatus according to claim 1, wherein said heating roller has a heat source therein.

5. An apparatus according to claim 1, wherein said fixing roller has a heat source therein.

* * * * *

UNITED STATES PATENT AND TRADEMARK OFFICE

CERTIFICATE OF CORRECTION

PATENT NO. : 7,050,748 B2
APPLICATION NO. : 11/110713
DATED : May 23, 2006
INVENTOR(S) : Masanori Akita et al.

It is certified that error appears in the above-identified patent and that said Letters Patent is hereby corrected as shown below:

COLUMN 5:
Line 27, "Also" should read --Also,--.
Line 39, "Also" should read --Also,--.
Line 43, "Also" should read --Also,--.

COLUMN 7:
Line 32, "Also" should read --Also,--.

Signed and Sealed this

Twenty-second Day of May, 2007

JON W. DUDAS
*Director of the United States Patent and Trademark Office*